US011370633B2

(12) United States Patent
Sato et al.

(10) Patent No.: US 11,370,633 B2
(45) Date of Patent: Jun. 28, 2022

(54) SHEET SORTING APPARATUS AND IMAGE FORMING APPARATUS

(71) Applicant: CANON KABUSHIKI KAISHA, Tokyo (JP)

(72) Inventors: Kazuhisa Sato, Suntou-gun (JP); Genki Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/852,046

(22) Filed: Apr. 17, 2020

(65) Prior Publication Data

US 2020/0239264 A1 Jul. 30, 2020

(30) Foreign Application Priority Data

Jan. 23, 2018 (JP) ..... 2018-008790

(51) Int. Cl.

| | |
|---|---|
| ***B65H 43/06*** | (2006.01) |
| ***B65H 31/24*** | (2006.01) |
| ***B65H 39/11*** | (2006.01) |
| ***B65H 29/58*** | (2006.01) |
| ***B65H 43/08*** | (2006.01) |

(Continued)

(52) U.S. Cl.

CPC ..... *B65H 43/06* (2013.01); *B65H 29/58* (2013.01); *B65H 31/02* (2013.01); *B65H 31/24* (2013.01); *B65H 43/02* (2013.01); *B65H 43/08* (2013.01); *B65H 2301/4212* (2013.01); *B65H 2405/11151* (2013.01); *B65H 2405/332* (2013.01); *B65H 2408/111* (2013.01); *B65H 2511/30* (2013.01); *B65H 2511/515* (2013.01); *B65H 2513/42* (2013.01); *B65H 2553/414* (2013.01); *B65H 2553/612* (2013.01); *B65H 2801/06* (2013.01)

(58) Field of Classification Search

CPC ..... B65H 43/06; B65H 43/02; B65H 43/08; B65H 31/24; B65H 31/22; B65H 39/11

See application file for complete search history.

(56) References Cited

U.S. PATENT DOCUMENTS 5,311,031 A * 5/1994 Gagliardo ..... G03B 27/585 250/559.29
6,443,449 B1 * 9/2002 Takagi ..... B65H 31/22 271/279

(Continued)

FOREIGN PATENT DOCUMENTS

JP 2002249273 A * 9/2002
JP 2005096902 A 4/2005

*Primary Examiner* — Luis A Gonzalez

(74) *Attorney, Agent, or Firm* — Canon U.S.A., Inc. I.P. Division

(57) ABSTRACT

A sheet sorting apparatus includes a first tray detachable from an apparatus main body, a second tray arranged below the first tray, a discharge unit to discharge a sheet to the first or second tray, a tray detecting unit to detect that the first tray is detached from the apparatus main body, a full stack detecting unit to detect a fully stacked condition of the first tray, and a control unit to control the discharge unit. In a case where the tray detecting unit detects that the first tray is detached from the apparatus main body, the control unit controls the discharge unit not to discharge a sheet to the second tray when a number of sheets discharged to the second tray reaches a threshold number of sheets, even though the full stack detecting unit does not detect the fully stacked condition.

11 Claims, 15 Drawing Sheets

(51) Int. Cl.
*B65H 31/02* (2006.01)
*B65H 43/02* (2006.01)

(56) References Cited

U.S. PATENT DOCUMENTS

| | | | | |
|---|---|---|---|---|
| 9,346,649 | B2 * | 5/2016 | Yamashita | B65H 31/10 |
| 10,662,021 | B2 * | 5/2020 | Sato | B65H 31/24 |
| 2002/0118351 | A1 * | 8/2002 | Takoh | B65H 39/11 355/72 |

* cited by examiner

SHEET SORTING APPARATUS AND IMAGE FORMING APPARATUS

CROSS REFERENCE TO RELATED APPLICATIONS

This application is a continuation of U.S. patent application Ser. No. 16/238,699, filed on Jan. 3, 2019, which claims priority from Japanese Patent Application No. 2018-008790, filed Jan. 23, 2018, each of which is hereby incorporated by reference herein in their entirety.

BACKGROUND OF THE INVENTION

Field of the Invention

The present disclosure relates to a sheet sorting apparatus and an image forming apparatus which have a plurality of discharge trays including a detachable discharge tray.

Description of the Related Art

Some of conventional image forming apparatuses may include a sheet sorting apparatus having a plurality of discharge trays. Such an apparatus has different discharge trays for users, for example, to sort and discharge sheets thereto, for example.

Japanese Patent Laid-Open No. 2000-44105 discloses a sheet sorting apparatus having a plurality of discharge trays that is detachable from an apparatus main body of the apparatus. For example, a first tray of the plurality of discharge trays may be detached to increase a space for stacking sheets (sheet stacking space) of a second tray arranged below the first tray so that a maximum number of sheets to be stacked in the second tray can be increased.

The sheet sorting apparatus according to Japanese Patent Laid-Open No. 2000-44105 includes a full stack detecting sensor configured to detect a fully stacked condition or a full stack of the first tray. When the first tray is detached and the sheet stacking space of the second tray is thus increased, a sheet discharging operation continues to the second tiny until the full stack detecting sensor detects a full stack.

However, in a case where the distance between the full stack detecting sensor for detecting a full stack of the first tray and the second tray is long and when sheets are discharged to the second tray until the full stack detecting sensor detects the full stack, the stackability of the sheets discharged to second tray may sometimes decrease.

SUMMARY OF THE INVENTION

The present disclosure can prevent a decrease of the stackability of sheets discharged to a second tray arranged below a first tray when the first tray is detached from a main body of an apparatus including them.

According to an aspect of the present disclosure, a sheet sorting apparatus includes a first tray detachable from an apparatus main body, a second tray arranged below the first tray, a discharge unit configured to discharge a sheet to the first tray or the second tray, a tray detecting unit configured to detect that the first tray is detached from the apparatus main body, a full stack detecting unit configured to detect a fully stacked condition of the first tray, and a control unit configured to control the discharge unit. In a case where the tray detecting unit detects that the first tray is detached from the apparatus main body, the control unit controls the discharge unit not to discharge a sheet to the second tray when a number of sheets discharged to the second tray reaches a threshold number of sheets, even though the full stack detecting unit does not detect the fully stacked condition.

Further features of the present disclosure will become apparent from the following description of embodiments with reference to the attached drawings.

DESCRIPTION OF THE EMBODIMENTS

Embodiment 1

Configuration of Image Forming Apparatus

Figure 1:
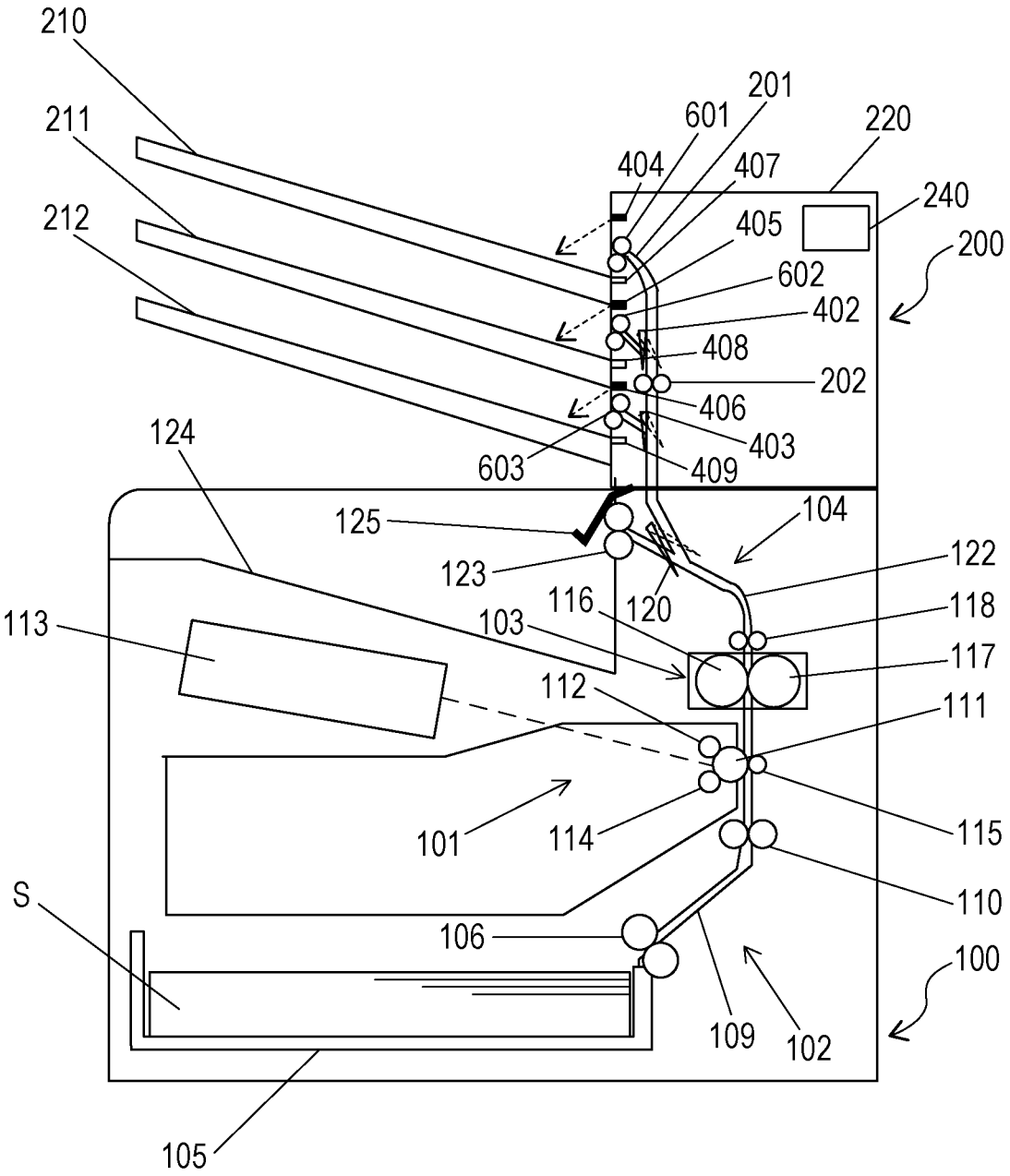
FIG. 1 illustrates configurations of an image forming apparatus and a sheet sorting apparatus according to Embodiment 1.

FIG. 1 illustrates a schematic structure of an image forming apparatus according to Embodiment 1 of the present disclosure. FIG. 1 illustrates a laser beam printer 100 (hereinafter, printer 100) as an image forming apparatus according to this embodiment.

As illustrated in FIG. 1, the printer 100 includes an image forming unit 101, a feed unit 102 configured to feed a sheet S (recording material) of paper, for example, to the image forming unit 101, a fixing unit 103 configured to fix an image formed on the sheet S by the image forming unit 101, and a discharge unit 104. A sheet sorting apparatus 200 is provided above the printer 100 and is configured to receive from the printer 100 and sort sheets S having images formed thereon.

The image forming unit 101 has a photosensitive drum 111 configured to rotate in counterclockwise direction in FIG. 1, a charging roller 112 configured to charge a surface of the photosensitive drum 111, and an exposure device 113 configured to apply light to the charged photosensitive drum 111 to form an electrostatic latent image on the photosensitive drum 11I. The image forming unit 101 further has a developing apparatus 114 configured to place toner onto the electrostatic latent image to form a toner image on the photosensitive drum 111, and a transfer roller 115 configured to transfer the toner image onto a conveyed sheet S. The image forming unit 101 is configured to form a toner image onto a sheet S by performing an image forming process. The fixing unit 103 has a fixing roller 116 and a pressurizing roller 117 configured to form a fixing nip portion with the fixing roller 116 and is configured to apply heat and pressure to a sheet S to fix the transferred toner image to the sheet S.

The feed unit 102 has a cassette 105 configured to contain in a stacking manner a plurality of sheets S to be used for image forming thereon, a feeding roller 106, a conveyance guide 109, and a registration roller 110. The discharge unit 104 has a switch member 120, a fix/discharge roller 118, a discharge guide 122, a discharge roller 123, a discharge tray 124, and a full stack detection flag 125. If a fully stacked condition or a full stack of the discharge tray 124 is detected based on the full stack detection flag 125, the printer 100 does not discharge a sheet S to the discharge tray 124 until removal of a sheet S discharged to the discharge tray 124.

Figure 11:
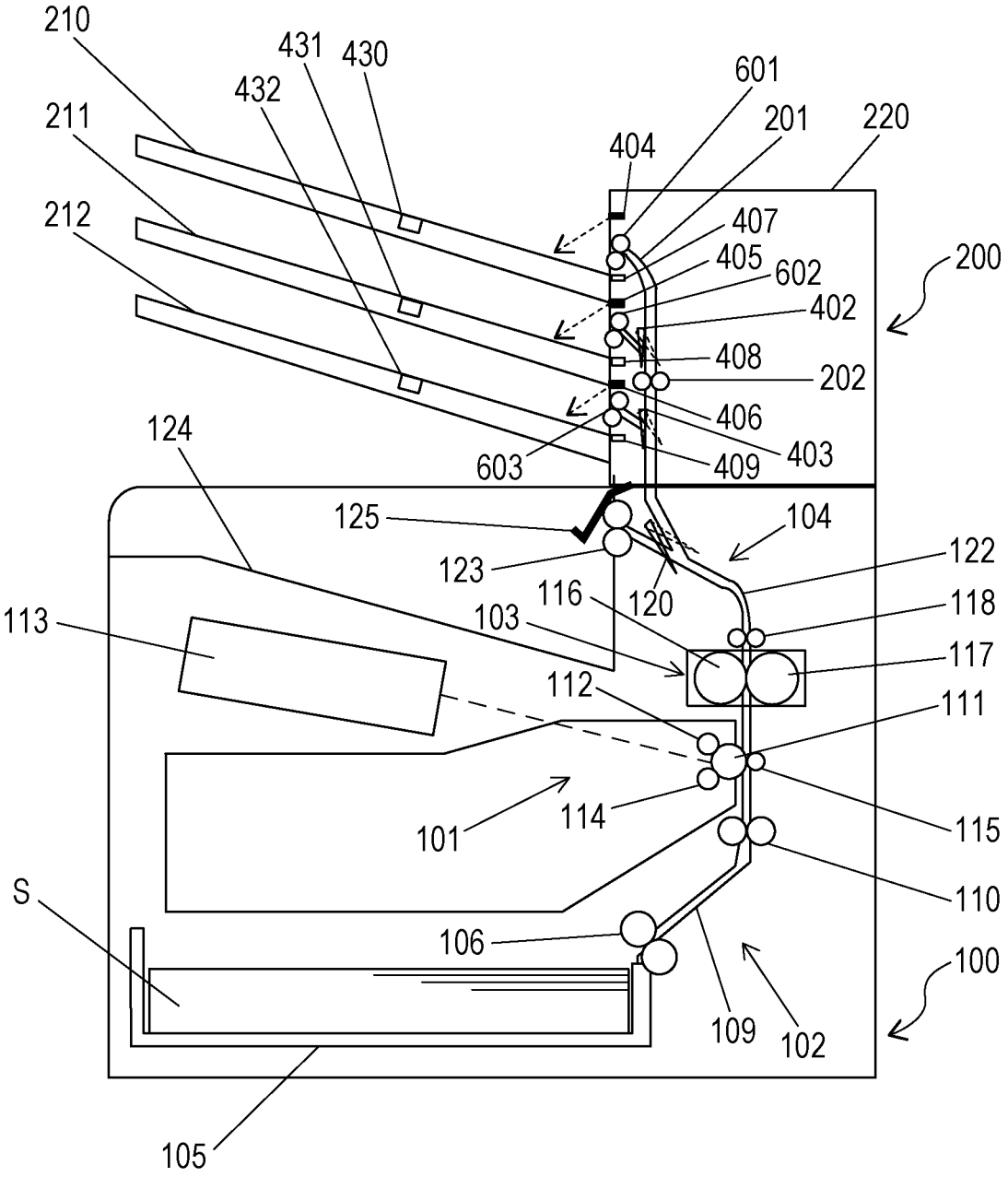
FIG. 11 illustrates configurations of an image forming apparatus and a sheet sorting apparatus according to Variation Example 1.

The switch member 120 is configured to be capable of being moved by an actuator, not illustrated, to a position indicated by the solid line in FIG. 11 for guiding a sheet S having undergone image forming to the sheet sorting apparatus 200 and to a position indicated by the broken line in FIG. 1 for guiding to the discharge tray 124.

Configuration of Sheet Sorting Apparatus

Next, with reference to FIG. 1, the sheet sating apparatus 200 according to this embodiment will be described. A conveyance guide 201 is configured to guide a sheet S conveyed from the printer 100. The conveyance guide 201 has a plurality of branches and diverges to discharge trays 210, 211, and 212. A conveyance roller pair 202 and discharge miler pairs 601, 602, and 603 are configured to discharge a sheet S to one of the discharge trays 210, 211, and 212. The discharge trays 210, 211, and 212 are arbitrarily detachable from the apparatus main body 220 (or a housing) of the sheet sorting apparatus 200. Here, a switch member 402 and a switch member 403 are configured to be capable of being moved by an actuator, not illustrated to the position indicated by the solid line and the position indicated by the broken line in FIG. 1. For example, in order to discharge a sheet S to the discharge tray 210, the switch member 402 and the switch member 403 are moved to the position indicated by the solid line in FIG. 1. In order to discharge a sheet S to the discharge tray 211, the switch member 402 is moved to the position indicated by the broken line in FIG. 1, and the switch member 403 is moved to the position indicated by the solid line indicated in FIG. 1.

Tray detecting sensors 407, 408, and 409 are sensors configured to detect that the discharge trays 210, 211, and 212, respectively, are detached from the apparatus main body 220. The tray detecting sensors 407, 408, and 409 may be photo-interrupters, for example, and each is configured to output an OFF signal in a through-beam mode in which the corresponding one of the discharge trays 210, 211, and 212 is detached from the apparatus main body 220 so that a light beam from the photo-interrupter is not shielded. Each of the tray detecting sensors 407, 408, and 409 is configured to output an ON signal in a beam shielded mode in which the corresponding one of the discharge trays 210, 211, and 212 is attached to the apparatus main body 220 to shield light beams from the photo-interrupters.

Full stack detecting sensors 404, 405, and 406 are sensors each configured to detect a full stack of the corresponding one of the discharge trays 210, 211, and 212. The full stack detecting sensors 404, 405, and 406 are optical sensors each configured to apply light to a sheet S discharged to the corresponding one of the discharge trays 210, 211, and 212 and receive light reflected by a surface of the sheet S. In a case where a lower number of sheets S are discharged to and stacked in the discharge trays 210, 211, or 212 and the position of the surface of the sheets S therein is low, the optical sensor receives a small quantity of light. On the other hand, in a case where a higher number of sheets S are discharged to and stacked in the discharge trays 210, 211, or 212 and the position of the surface of the sheets S therein is high, the optical sensor receives a larger quantity of light. Therefore, the optical sensor outputs an OFF signal when it receives a small quantity of light and outputs an ON signal when it receives a large quantity of light. Here, the term "full stack" refers to a state that the stacked number of sheets S after discharged to the discharge tray 210, 211, or 212 is equal to or higher than a predetermined number.

The sheet sorting apparatus 200 further has an operation panel 240 (operational display unit). A user can use the operation panel 240 to change settings for the printer 100 and the sheet sorting apparatus 200. The operation panel 240 has a screen for presenting a full stack notification associated with the discharge trays 210, 211, and 212 and a CANCEL FULL STACK button for notifying that a sheet S discharged to the discharge tray 210, 211, or 212 has been removed. Details thereof will be described below.

Control Unit and Functional Components

Figure 2:
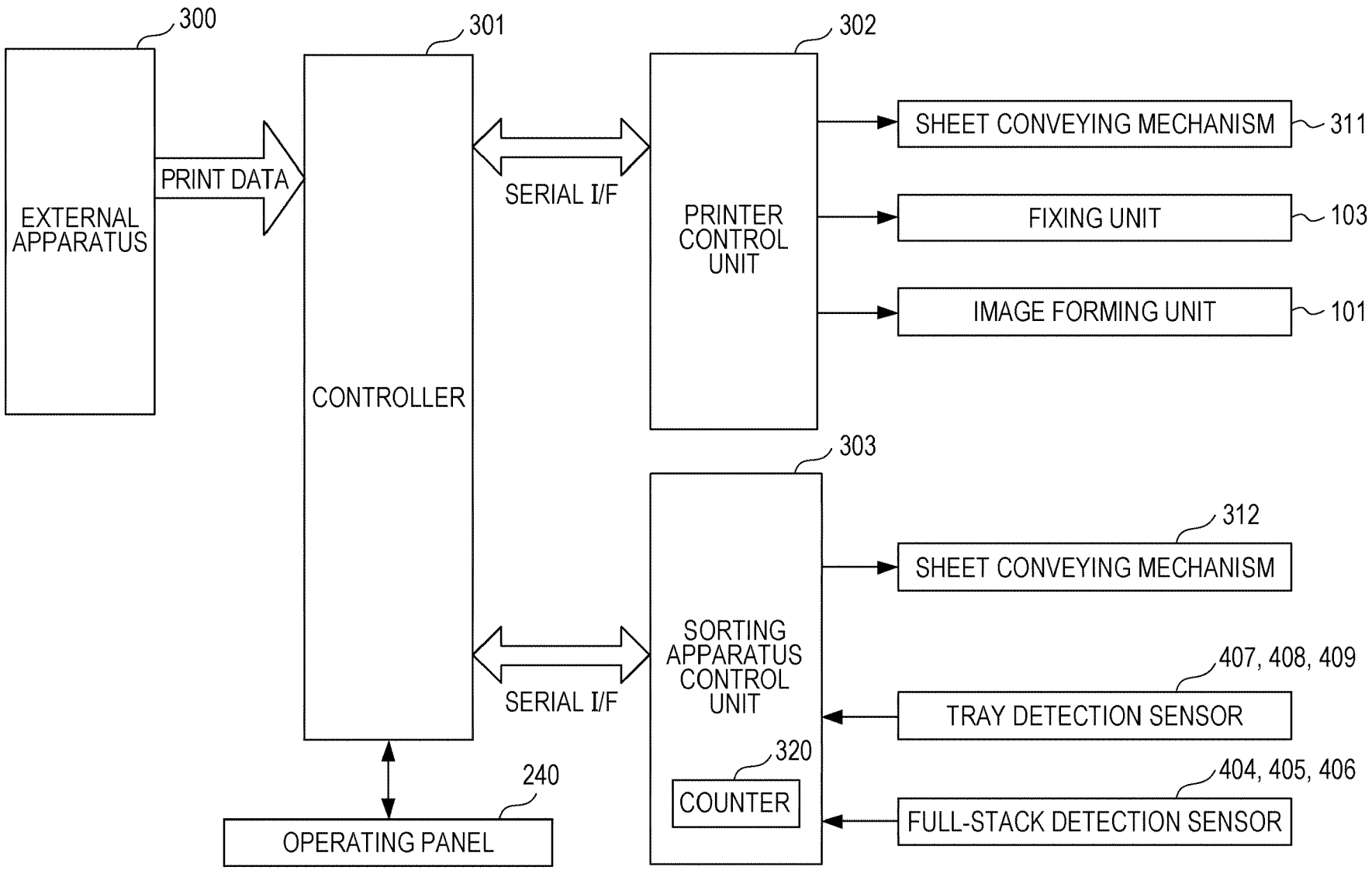
FIG. 2 is a block diagram illustrating a control unit and functional components in the image forming apparatus according to Embodiment 1.

FIG. 2 is a block diagram illustrating functional components according to this embodiment. The printer 100 includes, as a control unit, a controller 301, a printer control unit 302 configured to control the printer 100, and a sorting apparatus control unit 303 configured to control the sheet sorting apparatus 200. The controller 301 is configured to communicate with the external apparatus 300 such as a host computer to receive print data. The controller 301 is further configured to designate a print condition generated from the print data and give a print instruction to the printer control unit 302 via a serial I/F. The printer control unit 302 controls mechanisms in accordance with a print condition received from the controller 301. More specifically, the printer control unit 302 may control a sheet conveying mechanism 311 including a feed unit 102 and a discharge unit 104 to feed and discharge a sheet S and may control the image forming unit 101 and the fixing unit 103 to image forming and fixing on the sheet S.

The controller 301 is further configured to designate a sorting destination of a sheet S to the sorting apparatus control unit 303 via the serial I/F. The sorting apparatus control unit 303 is configured to control mechanisms in accordance with the sorting destination designated by the controller 301. More specifically, the sorting apparatus control unit 303 is configured to control a sheet conveying mechanism 312 including the conveyance roller pair 202, the discharge roller pairs 601, 602, and 603, and the switch members 402 and 403 to convey a sheet S having undergone image forming thereon. The sorting apparatus control unit 303 is further configured to detect the presence or absence of the discharge trays 210, 211, and 212 based on detection results from the tray detecting sensors 407, 408, and 409. The sorting apparatus control unit 303 is further configured to detect a full stack of the discharge trays 210, 211, and 212 based on detection results from the full stack detecting sensors 404, 405, and 406. The sorting apparatus control unit 303 further has a counter 320 configured to count the number of sheets S discharged to each of the discharge trays 210, 211, and 212. The counter 320 may be provided in the controller 301.

The operation panel 240 is connected to the controller 301. As described above, a user can give various instructions to the controller 301 through the operation panel 240. The controller 301 may display a message and an image on the operation panel 240 so that various kinds of information can be notified to a user.

Details of Sorting Apparatus Control Unit

Figure 3:
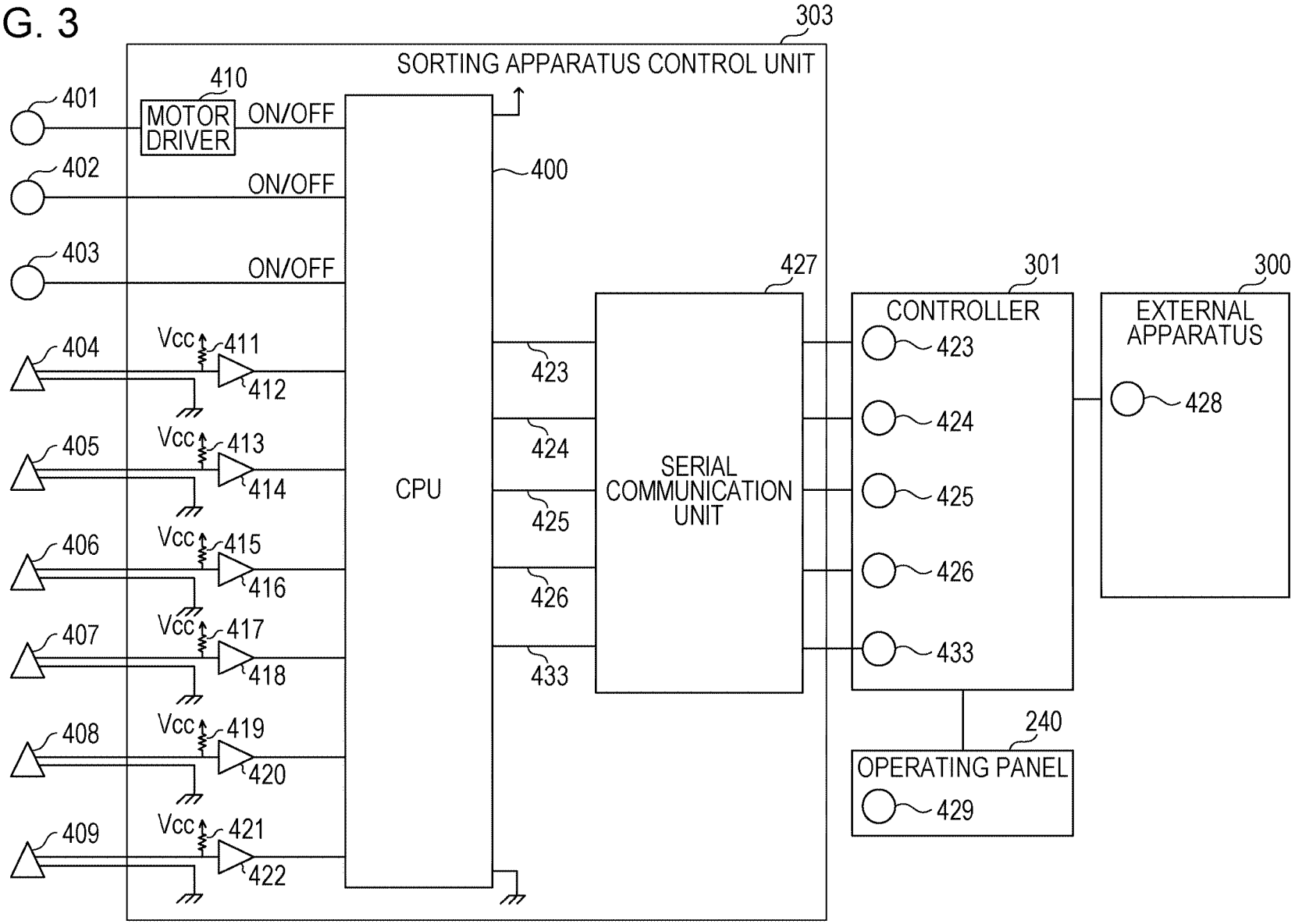
FIG. 3 is a detail diagram illustrating the sorting apparatus control unit according to Embodiment 1.

FIG. 3 is a detail diagram illustrating the sorting apparatus control unit 303 according to this embodiment. The sorting apparatus control unit 303 has a CPU 400 and communicates with the controller 301 through a serial communication unit 427. The serial communication unit 427 connects the CPU 400 and the controller 301 via a plurality of signal lines.

When print data 428 are notified to the controller 301 through the external apparatus 300, the controller 301 notifies a signal representing an entry notice 423 and discharge destination information 424 to the CPU 400 through the serial communication unit 427. A signal representing a tray presence/absence state 425 is also notified from the CPU 400 to the controller 301 via the serial communication unit 427. When a signal representing a fully stacked condition 426 is notified from the CPU 400 to the controller 301 via the serial communication unit 427, a full stack indication 429 is notified on the operation panel 240. Here, the expression "a full stack indication 429 is notified" refers to display of a message or an image informing that a tray that is the discharge target of a sheet S has a fully stacked condition on a screen of the operation panel 240.

Figure 4:
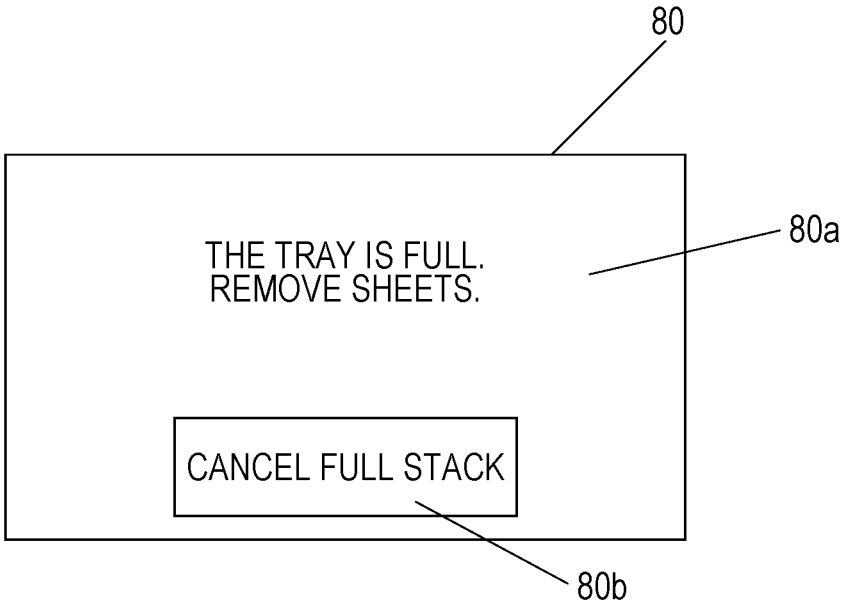
FIG. 4 illustrates an example of a full stack notification screen according to Embodiment 1.

FIG. 4 illustrates an example of a full stack notification screen 80 to be displayed on the operation panel 240. The full stack notification screen 80 includes a message 80*a* informing that a tray that is a discharge target has a fully stacked condition and a CANCEL FULL STACK button 80*b* for checking whether a user has performed an operation for removing sheets S from the tray that is a discharge target to cancel the fully stacked condition. When a user presses the CANCEL FULL STACK button 80*b*, a signal representing a full stack cancel instruction 433 is notified from the controller 301 to the CPU 400 through the serial communication unit 427.

A motor driver 410 is connected to an output terminal of the CPU 400. The motor driver 410 drives a conveyance motor 401. Rotation of the conveyance motor 401 can rotate the conveyance roller pair 202 and the discharge roller pairs 601, 602, 603 so that a sheet S is conveyed to one of the discharge trays 210, 211, and 212.

An actuator (not illustrated) for changing the position of the switch member 402 is connected to the output terminal of the CPU 400. When the actuator has an ON state, the switch member 402 is changed in its position into the position indicated by the broken line in FIG. 1 so that a sheet S is guided to the direction toward the discharge tray 211. When the actuator has an OFF state, the switch member 402 is changed in its position to the position indicated by the solid line in FIG. 1 so that a sheet S is guided to a direction toward the discharge tray 210.

An actuator (not illustrated) configured to change the position of the switch member 403 is connected to the output terminal of the CPU 400. When the actuator has an ON state, the switch member 403 is changed in its position to the position indicated by the broken line in FIG. 1 so that a sheet S can be guided to a direction toward the discharge tray 212. When the actuator has an OFF state, the switch member 403 is changed in its position to the position indicated by the solid line in FIG. 1 so that a sheet S is guided to a direction toward the discharge trays 210 and 211.

The full stack detecting sensor 404 uses a pull-up 411 and is configured to input a sensor state (an ON signal or an OFF signal) to the CPU 400 through a buffer 412. Because details of the full stack detecting sensors 405 and 406 are the same as those of the full stack detecting sensor 404, any repetitive description will be omitted.

The tray detecting sensor 407 uses a pull-up 417 and is configured to input a sensor state (an ON signal or an OFF signal) to the CPU 400 through a buffer 418. Because details of the tray detecting sensors 408 and 409 are the same as those of the tray detecting sensor 407, any repetitive descriptions will be omitted.

Extension of Sheet Stacking Space

Figure 5A:
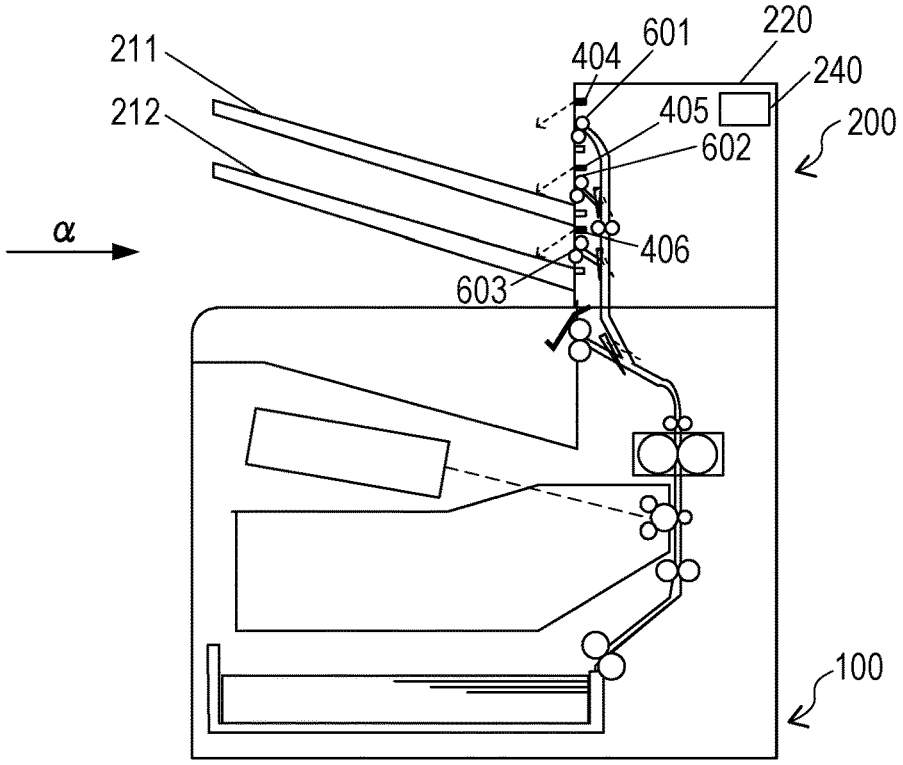
FIGS. 5A and 5B illustrate states in which a discharge tray is detached from the sheet sorting apparatus.
Figure 5B:
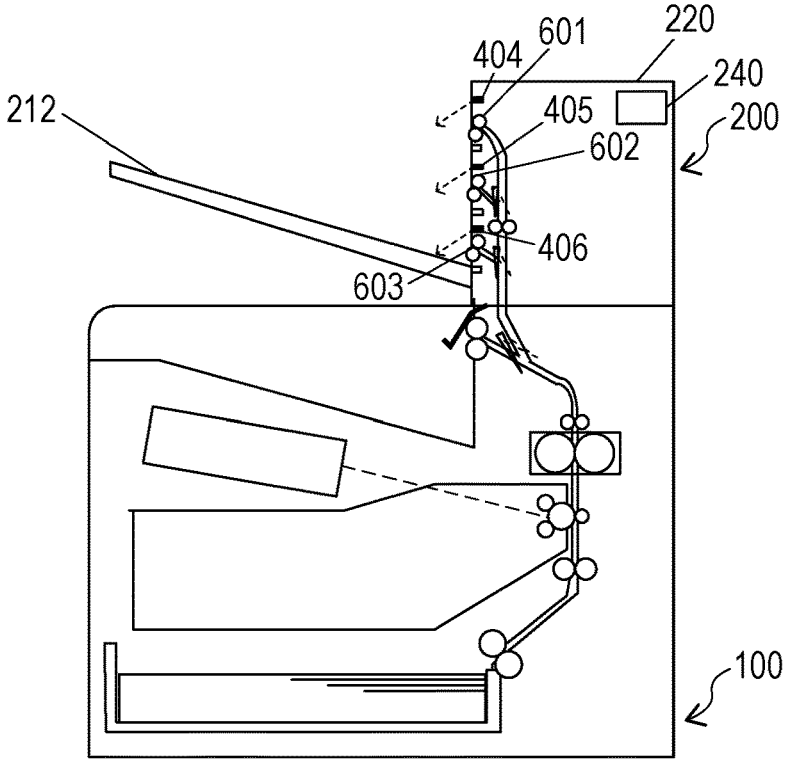

FIG. 5A illustrates a state that the discharge tray 210 is detached from the apparatus main body 220 of the sheet sorting apparatus 200, and FIG. 5B illustrates a state that the discharge trays 210 and 211 are detached from the apparatus main body 220 of the sheet sorting apparatus 200.

When the discharge trays 210 and 211 are attached to the apparatus main body 220 as illustrated in FIG. 1, the 200 sheets S can be stacked in each of the discharge trays 210, 211, and 212. On the other hand, when the discharge tray 210 is detached from the apparatus main body 220 as illustrated in FIG. 5A, 600 sheets S can be stacked in the discharge tray 211. When the discharge trays 210 and 211 are detached from the apparatus main body 220 as illustrated in FIG. 5B, 1000 sheets S can be stacked in the discharge tray 212.

Figure 6:
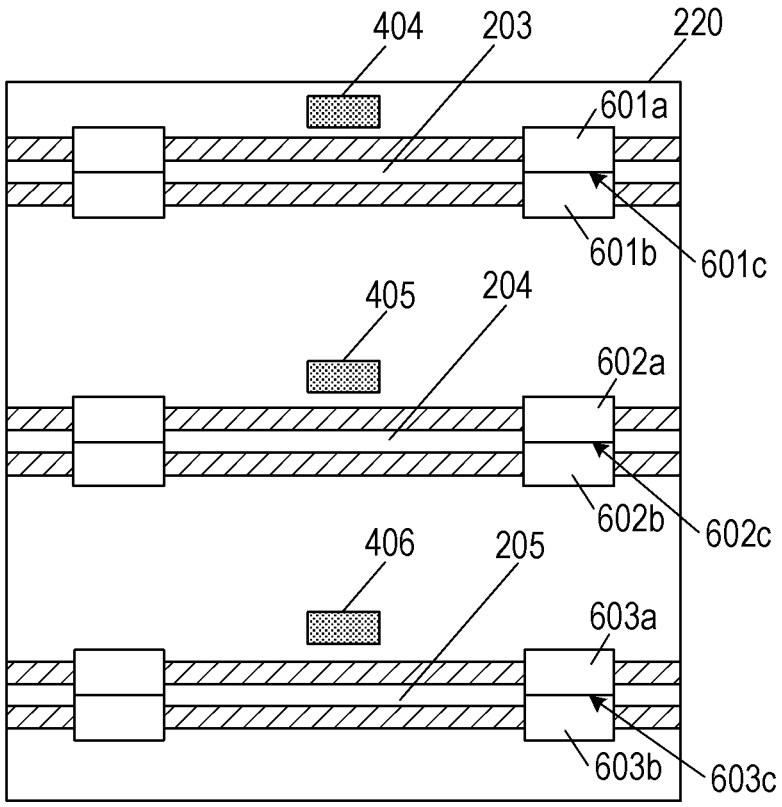
FIG. 6 illustrates a configuration of the sheet sorting apparatus according to Embodiment 1.

FIG. 6 illustrates the sheet sorting apparatus 200 illustrated in FIGS. 5A and 5B viewed from a direction indicated by an arrow $\alpha$ in FIG. 5A. FIG. 6 does not illustrate the discharge trays 210, 211, and 212. The apparatus main body 220 has discharging ports 203, 204, and 205, and sheets S discharged by the discharge roller pair 601, 602, 603 pass through the discharging ports 203, 204, and 205.

The full stack detecting sensor 406 has an ON state in a case where the height of the top sheet S stacked in the discharge tray 212 is equal to or higher than the height of a nip portion 603*c* formed by an upper roller 603*a* and a lower roller 603*b* of the discharge miller pair 603. On the other hand, the full stack detecting sensor 406 has an OFF state in a case where the height of the top sheet S stacked in the discharge tray 212 is lower than the height of the nip portion 603. In the configuration according to this embodiment, when 200 sheets S are stacked in the discharge tray 212, the full stack detecting sensor 406 outputs an ON signal.

The full stack detecting sensor 405 is configured to detect the presence or absence of the sheet S at a height position of a nip portion 602*c* formed by an upper roller 602*a* and a lower roller 602*b* of the discharge roller pair 602. In a case where the discharge tray 211 is attached to the apparatus main body 220 and when 200 sheets S are stacked in the discharge tray 211, the full stack detecting sensor 405 outputs an ON signal in the configuration according to this embodiment. In a case where the discharge tray 211 is not attached to the apparatus main body 220, the full stack detecting sensor 405 detects a full stack of sheets S discharged to the discharge tray 212. A sum of a total of 400 sheets stackable in the discharge trays 211 and 212 and the number of sheets (such as 200 sheets) stackable in a space generated by the detachment of the discharge tray 211 is equal to a total of 600 sheets. When 600 sheets S are stacked in the discharge tray 212, the full stack detecting sensor 405 outputs an ON signal.

The full stack detecting sensor 404 is configured to detect the presence or absence of a sheet S at a height position of a nip portion 601*c* formed by an upper roller 601*a* and a lower roller 601*b* of the discharge roller pair 601.

In a case where the discharge tray 210 is attached to the apparatus main body 220 and when 200 sheets S are stacked in the discharge tray 210 in the configuration of this embodiment, the full stack detecting sensor 404 outputs an ON signal. In a case where the discharge trays 210 and 211 are not attached to the apparatus main body 220, the full stack detecting sensor 404 detects a full stack of sheets S discharged to the discharge tray 212. A sum of a total of 600 sheets stackable in the discharge trays 210, 211, and 212 and the number (such as 400) of sheets stackable in a space generated by removal of the discharge trays 210 and 211 is equal to a total of 1000 sheets. When 1000 sheets S are stacked in the discharge tray 212, the full stack detecting sensor 405 outputs an ON signal.

Description of State with Reduced Sheet Stackability

Next, a discharge operation to be performed by the sheet sorting apparatus 200 from which a discharge tray is detached will be described. When a sheet S is fed from the printer 100, the sheet sorting apparatus 200 selects a discharge destination for the sheet S from the discharging ports 203, 204, and 205 based on detection results from the full stack detecting sensor 404, 405, and 406. More specifically, a discharging port closest to the printer 100 or lowest in the perpendicular direction among discharging ports excluding a discharging port already having a fully stacked condition is determined as the discharge destination. When sheets S are discharged continuously, the sheet sorting apparatus 200 sequentially determines a discharge port every time one sheet S is discharged based on the detection results from the full stack detecting sensors 404, 405, and 406.

For example, a case will be described in which a sheet S is discharged from the discharging port 205 to the discharge tray 212 when the discharge trays 210 and 211 are detached from the apparatus main body 220. When the full stack detecting sensor 406 detects a full stack, the sheet sorting apparatus 200 determines the upper discharging port 204 than the discharging port 205 as a discharge destination. Next, when the full stack detecting sensor 405 detects a full stack, the sheet sorting apparatus 200 determines the upper discharging port 203 than the discharging port 204 as a discharge destination.

Figure 7A:
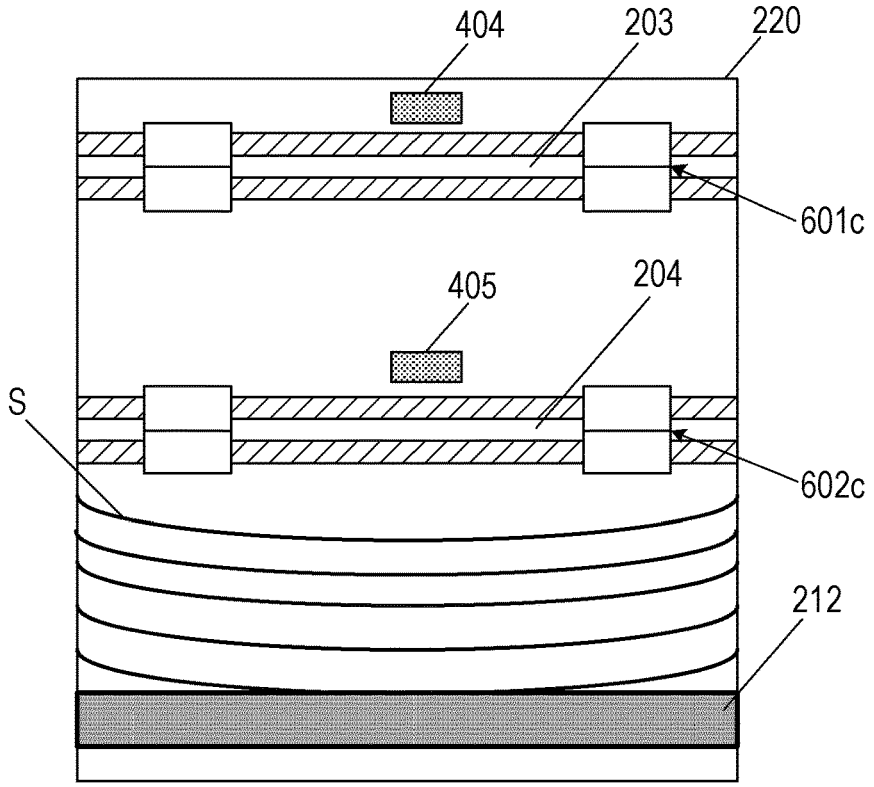
FIGS. 7A and 7B illustrate a state in which a discharge tray is detached and sheets are stacked.
Figure 7B:
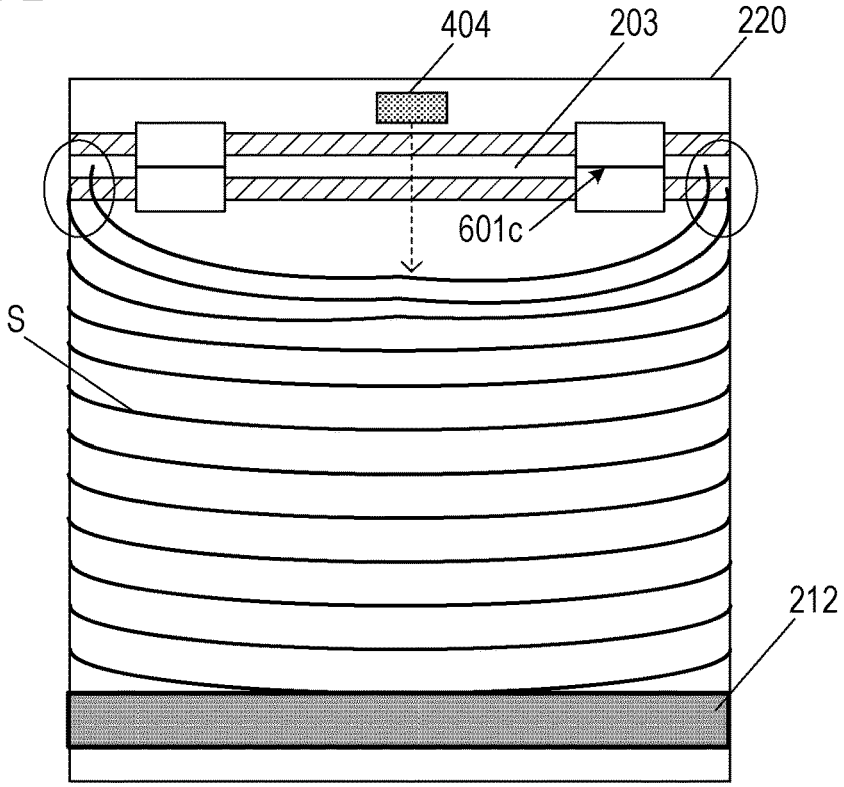

FIGS. 7A and 7B illustrate the sheet sorting apparatus 200 illustrated in FIG. 6 and FIGS. 5A and 5B, viewed from the direction indicated by the arrow α. FIGS. 7A and 7B particularly illustrate a state in which the discharge trays 210 and 211 illustrated in FIG. 5B are detached from the apparatus main body 220 and in which the discharge tray 212 is attached to the apparatus main body 220. Referring to FIGS. 7A and 7B, a sheet S discharged to the discharge tray 212 has a curl in a width direction (orthogonal to the sheet-S discharge direction).

FIG. 7A illustrates a state in which sheets S are stacked closely to the discharging port 204. The curl has a small influence, and the sheets S stacked in the discharge tray 212 are aligned substantially in parallel with the discharge tray 212. On the other hand, FIG. 7B illustrates a state in which sheets S are stacked closely to the discharging port 203. End parts of sheets S having a large influence of accumulated curls in the discharge tray 212 are stacked to partially block the discharging port 203. Referring to FIG. 7B, the full stack detecting sensor 404 has not detected a full stack yet. When the sheets S are continuously discharged from the discharging port 203 in this state, the top sheet S stacked in the discharge tray 212 may collide with a newly discharged sheet S, which may lead a conveyance malfunction. Even when an amount of curl of one sheet S is small, a stack of a large number of the curled sheets S has a large influence on the top sheet S. As a result, the stackability of the sheets S to be stacked in the discharge tray 212 may decrease.

Description of Operations of Sheet Sorting Apparatus

Figure 8A:
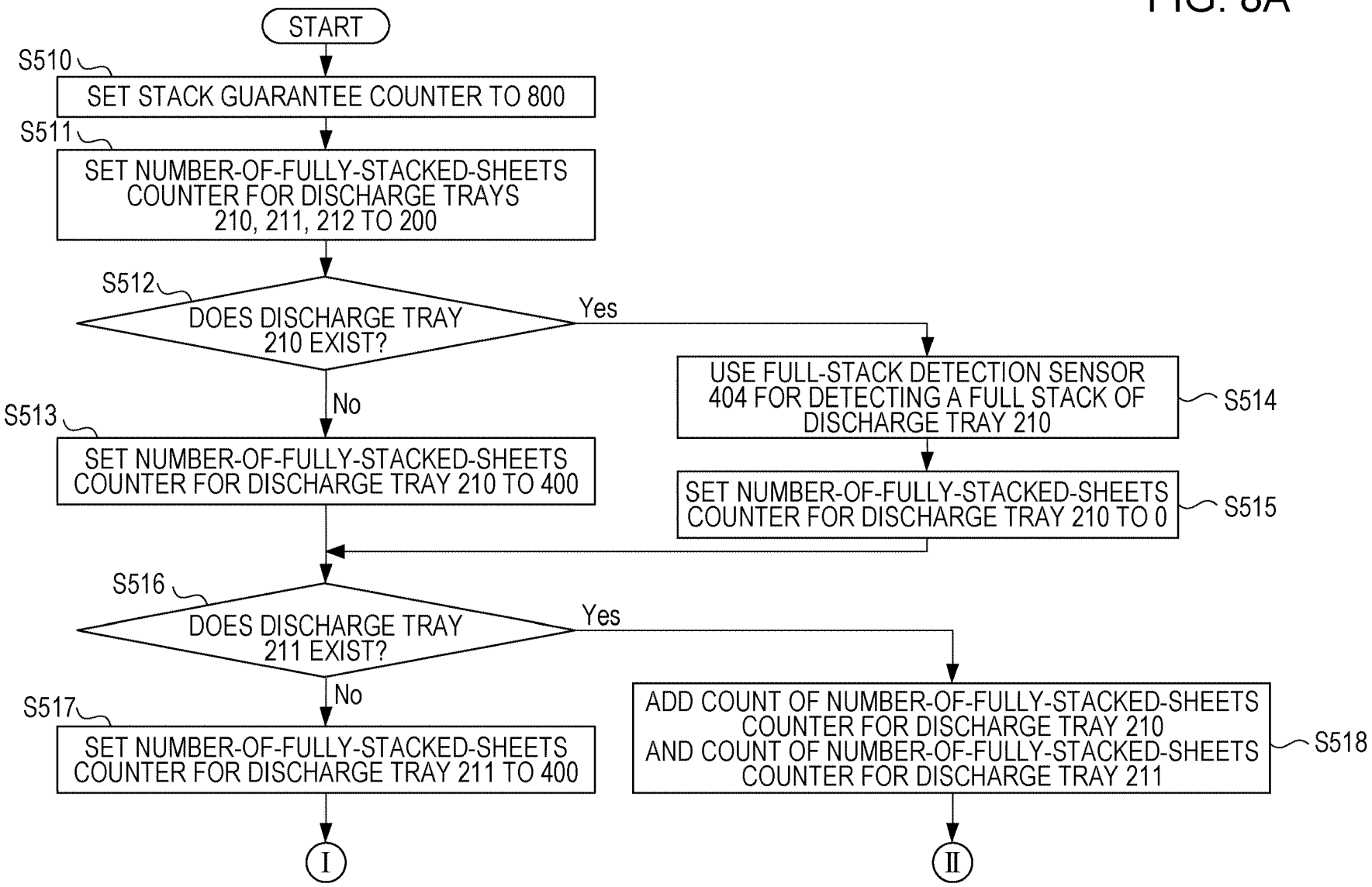
FIGS. 8A to 8C are flowcharts illustrating processing for determining a full-stack detection method according to Embodiment 1.
Figure 8B:
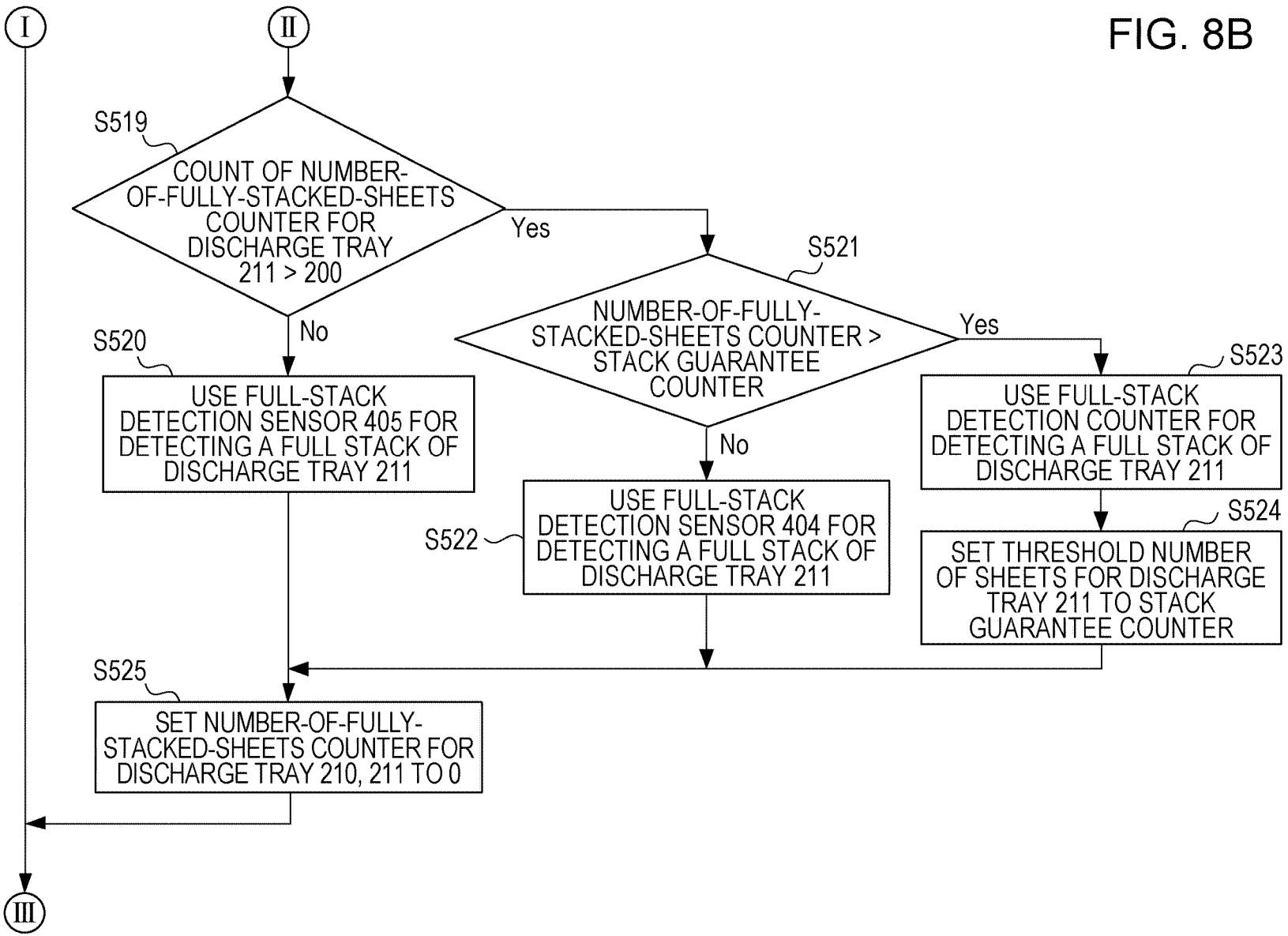
Figure 8C:
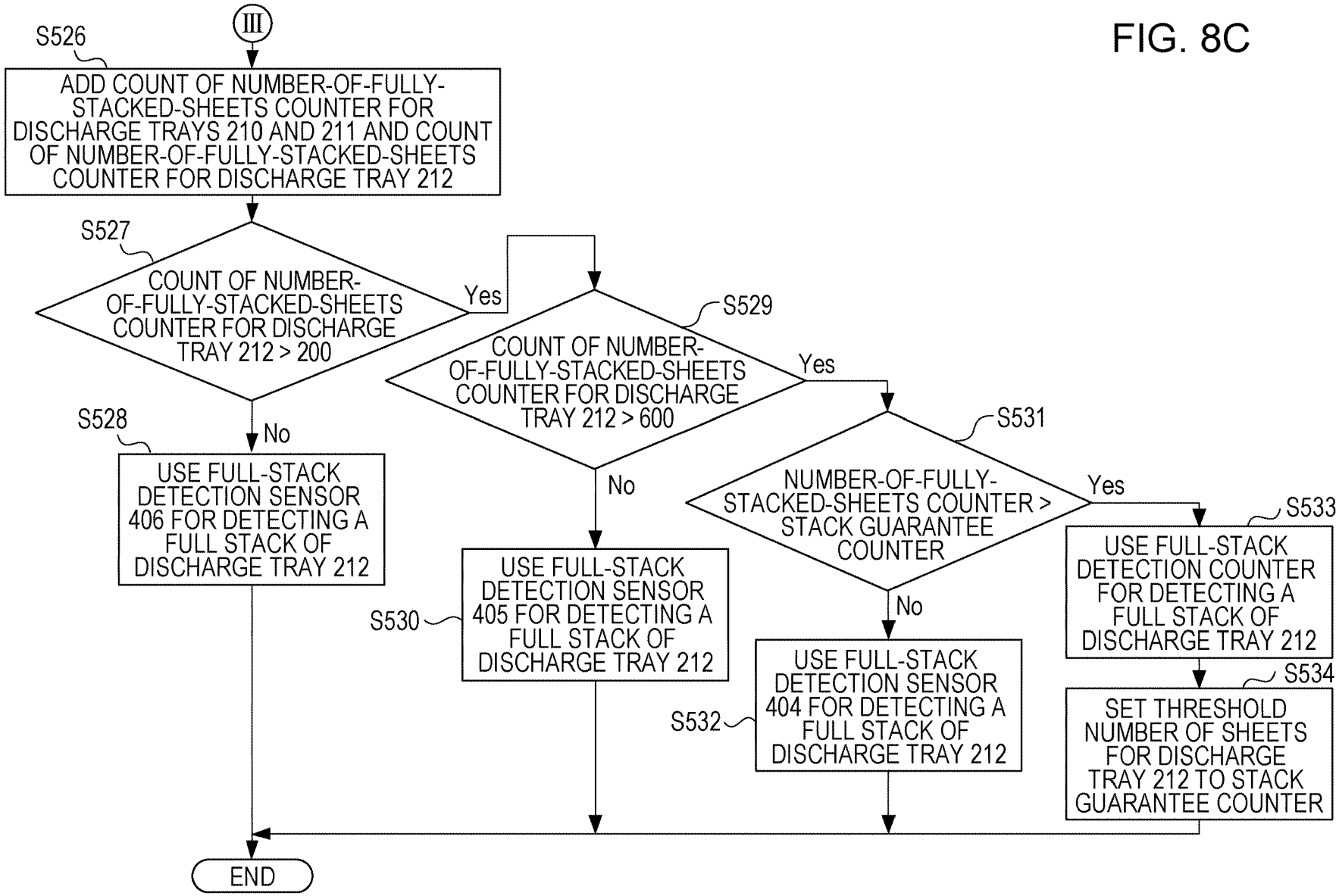

In order to address of such a decrease of the stackability of sheets S, the following controls are performed according to this embodiment. FIGS. 8A to 8C are flowcharts illustrating processing for determining a full-stack detection method for the sheet sorting apparatus 200 according to this embodiment. The controls based on the flowcharts are executed based on a program stored in a ROM, not illustrated, in the sorting apparatus control unit 303 illustrated in FIG. 2.

Referring to FIGS. 8A to 8C, when a printing operation starts, the sorting apparatus control unit 303 sets a stack guarantee counter to 800 (S510). The stack guarantee counter is a counter indicating the number of sheets S that does not reduce the stackability of sheets S when only the discharge tray 212 is attached to the apparatus main body 220 and sheets S are discharged to the discharge tray 212. Next, the sorting apparatus control unit 303 sets number-of-fully-stacked-sheets counters for the discharge trays 210, 211, and 212 to 200 (S511). The number-of-fully-stacked-sheets counter is a counter indicating the number of sheets S to be detected as a full stack. According to embodiment, the numbers such as 800 and 200 of sheets S are given for illustration purpose and can be changed in accordance with configuration and size of the apparatus.

The sorting apparatus control unit 303 checks whether the discharge tray 210 is attached to the apparatus main body 220 (S512). If the discharge tray 210 is attached (S512: Yes), the sorting apparatus control unit 303 employs a method using the full stack detecting sensor 404 as a full-stack detection method for the discharge tray 210 (S514). In other words, sheets S can be discharged to the discharge tray 210 until the full stack detecting sensor 404 detects a full stack. The sorting apparatus control unit 303 then sets the number-of-fully-stacked-sheets counter for the discharge tray 210 to 0 (S515). On the other hand, if the discharge tray 210 is not attached (S512: No), the sorting apparatus control unit 303 sets the number-of-fully-stacked-sheets counter for the discharge tray 210 to 400 in consideration of the stackable number of sheets in a space generated by detachment of the discharge tray 210 (S513).

Next, the sorting apparatus control unit 303 checks whether the discharge tray 211 is attached to the apparatus main body 220 (S516). If the discharge tray 211 is attached (S516: Yes), the sorting apparatus control unit 303 adds a value of the number-of-fully-stacked-sheets counter for the discharge tray 210 to a value of the number-of-fully-stacked-sheets counter for the discharge tray 211 (SS 18). The sorting apparatus control unit 303 checks whether the number-of-fully-stacked-sheets counter for the discharge tray 211 has a value higher than 200 (S519).

If the number-of-fully-stacked-sheets counter for the discharge tray 211 has a value higher than 200 (S519: Yes), the discharge tray 210 is not attached to the apparatus main body 220. The sorting apparatus control unit 303 checks whether the number-of-fully-stacked-sheets counter for the discharge tray 211 has a value higher than the value of the stack guarantee counter (S521). If the number-of-fully-stacked-sheets counter for the discharge tray 211 has a value higher than the stack guarantee counter (S521: Yes), the sorting apparatus control unit 303 employs the method using the number-of-fully-stacked-sheets counter as a full-stack detection method for the discharge tray 211 (S523). In other words, sheets S can be discharged to the discharge tray 211 until the number of sheets S discharged to the discharge tray 211 reaches a threshold number of sheets. The sorting apparatus control unit 303 sets the threshold number of sheets when the discharge tray 211 is fully stacked to the value of the stack guarantee counter (S524). If the number-of-fully-stacked-sheets counter for the discharge tray 211 has a value not higher than the value of stack guarantee counter (S521: No), the sorting apparatus control unit 303 employs the method using the full stack detecting sensor 404 as a full-stack detection method for the discharge tray 211 (S522). In other words, sheets S can be discharged to the discharge tray 211 until the full stack detecting sensor 404 detects a full stack.

If the number-of-fully-stacked-sheets counter for the discharge tray 211 has a value not higher than 200 (519: No), the discharge tray 210 is attached to the apparatus main body 220. The sorting apparatus control unit 303 employs the method using the full stack detecting sensor 405 as a full-stack detection method for the discharge tray 211 (S520). If the full-stack detection method is determined, the sorting apparatus control unit 303 sets the number-of-fully-stacked-sheets counters for the discharge trays 210 and 211 to 0 (S525).

In order to determine the full-stack detection method for the discharge tray 212, the sorting apparatus control unit 303 adds the value of the number-of-fully-stacked-sheets counter for the discharge tray 212 to the values of the number-of-fully-stacked-sheets counters for the discharge trays 210 and 211 (S526). The sorting apparatus control unit 303 checks whether the number-of-fully-stacked-sheets counter for the discharge tray 212 has a value higher than 200 (S527). If the number-of-fully-stacked-sheets counter for the discharge tray 212 has a value higher than 200 (S527: Yes), the sorting apparatus control unit 303 checks whether the number-of-fully-stacked-sheets counter for the discharge tray 212 has a value higher than 600 (S529).

If the number-of-fully-stacked-sheets counter for the discharge tray 212 has a value higher than 600 (S529: Yes), the discharge trays 210 and 211 are not attached to the apparatus main body 220. The sorting apparatus control unit 303 checks whether the number-of-fully-stacked-sheets counter for the discharge tray 212 has a value higher than the value of the stack guarantee counter (S531). If the number-of-fully-stacked-sheets counter for the discharge tray 212 has a value higher than the value of the stack guarantee counter (S531: Yes), the sorting apparatus control unit 303 employs the method using the number-of-fully-stacked-sheets counter as a full-stack detection method for the discharge tray 212 (S533). In other words, sheets S can be discharged to the discharge tray 212 until the number of sheets S discharged to the discharge tray 212 reaches a threshold number of sheets. The sorting apparatus control unit 303 sets the threshold number of sheets for detecting a full stack of the discharge tray 212 to the value of the stack guarantee counter (S534). If the number-of-fully-stacked-sheets counter for the discharge tray 212 has a value not higher than the value of the stack guarantee counter (S531: No), the sorting apparatus control unit 303 employs the method using the full stack detecting sensor 404 as a full-stack detection method for the discharge tray 212 (S532). In other words, sheets S can be discharged to the discharge tray 212 until the full stack detecting sensor 404 detects a full stack.

If the number-of-fully-stacked-sheets counter for the discharge tray 212 has a value not higher than 600 (S529: No), the discharge tray 210 is attached to the apparatus main body 220, but the discharge tray 211 is not attached to the apparatus main body 220. The sorting apparatus control unit 303 employs the method using the full stack detecting sensor 405 as a full-stack detection method for the discharge tray 212 (S532). In other words, sheets S can be discharged to the discharge tray 212 until the full stack detecting sensor 405 detects a full stack.

If the number-of-fully-stacked-sheets counter for the discharge tray 212 has a value not higher than 200 (527: No), the discharge tray 211 is attached to the apparatus main body 220. The sorting apparatus control unit 303 employs the method using the full stack detecting sensor 406 as a full-stack detection method for the discharge tray 212 (S528). In other words, sheets S can be discharged to the discharge tray 212 until the full stack detecting sensor 406 detects a full stack. The controls in the flowcharts end here.

Figure 9A:
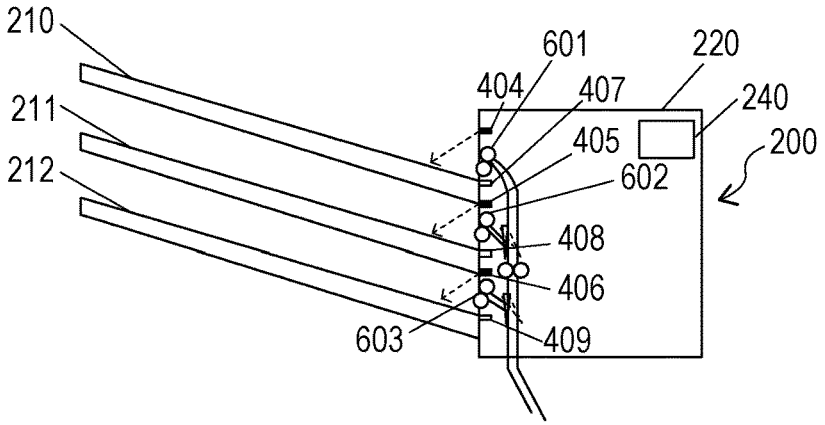
FIGS. 9A to 9D illustrate combinations of detachments of discharge trays.
Figure 9B:
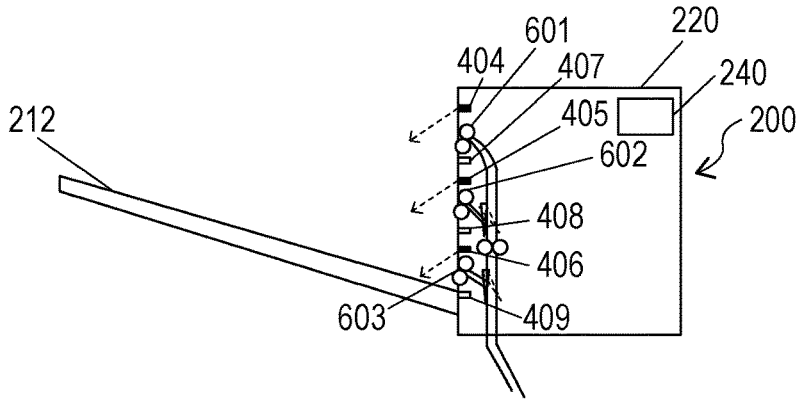
Figure 9C:
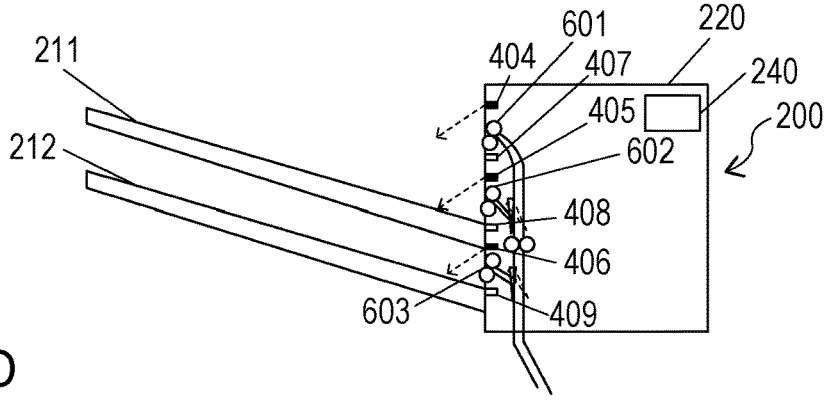
Figure 9D:
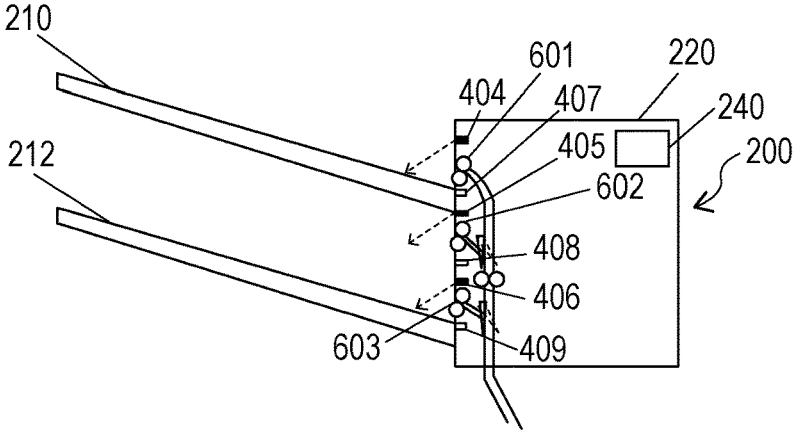

FIGS. 9A to 9D illustrate variations of the attaching/detaching states of the discharge trays 210, 211, and 212. FIG. 9A illustrates a state in which all of the discharge trays 210, 211, and 212 are attached to the apparatus main body 220. FIG. 9B illustrates a state in which the discharge trays 210 and 211 are detached from the apparatus main body 220. FIG. 9C illustrates a state in which the discharge tray 210 is detached from the apparatus main body 220 and in which the discharge tray 211 is attached to the apparatus main body 220. FIG. 9D illustrates a state in which the discharge tray 210 is attached to the apparatus main body 220 and in which the discharge tray 211 is detached from the apparatus main body 220.

In the configuration according to this embodiment, by following the flowcharts in FIGS. 8A to 8C, full-stack detection methods for the states in FIG. 9A to 9D are determined as follows. For the state in FIG. 9A, the method using the full stack detecting sensor 404 is employed as a full-stack detection method for the discharge tray 210 (S514). Then, the method using the full-stack detecting sensor 405 is employed as a full-stack detection method for the discharge tray 211 (S520). Then, the method using the full-stack detecting sensor 406 is employed as a full-stack detection method for the discharge tray 212 (S528). For the state in FIG. 9B, the method using the number-of-fully-stacked-sheets counter is employed as a full-stack detection method for the discharge tray 212 (S533). For the state in FIG. 9C, the method using the full-stack detecting sensor 404 is employed as a full-stack detection method for the discharge tray 211 (S522). Then, the method using the full-stack detecting sensor 406 is employed as a full-stack detection method for the discharge tray 212 (528). For the state in FIG. 9D, the method using the full-stack detecting sensor 404 is employed as a full-stack detection method for the discharge tray 210 (S514). Then, the method using the full-stack detecting sensor 405 is employed as a full-stack detection method for the discharge tray 212 (S530).

Figure 10:
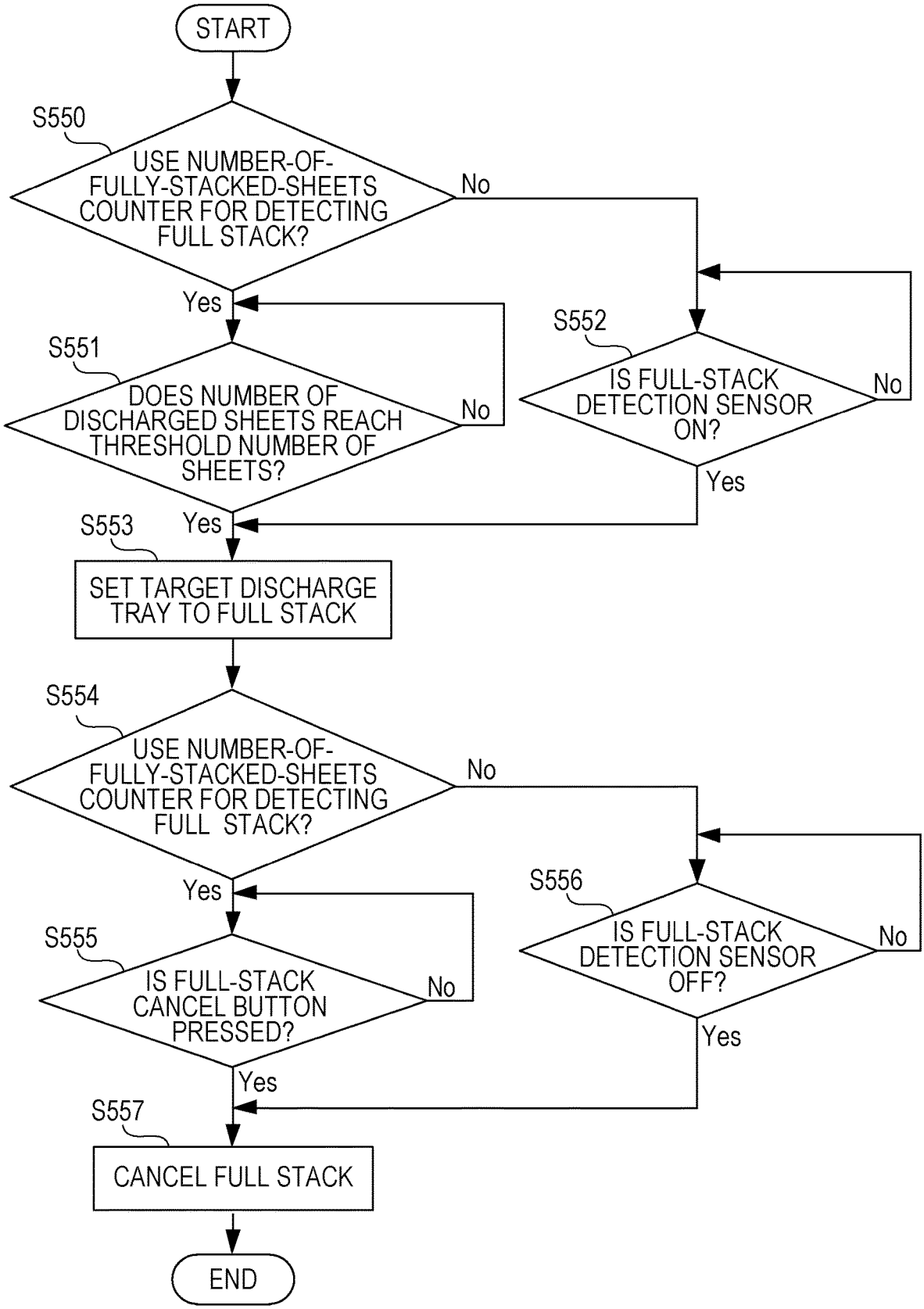
FIG. 10 is a flowchart illustrating processing for releasing a full stack according to Embodiment 1.

FIG. 10 is a flowchart illustrating operations from detection of a full stack to cancellation of the full stack. Controls based on this flowchart are executed based on a program stored in a ROM, not illustrated, in the sorting apparatus control unit 303 illustrated in FIG. 2.

The sorting apparatus control unit 303 checks whether the full-stack detection methods for the discharge trays 210, 211, and 212 are the method using the number-of-fully-stacked-sheets counter or not (S550). If the full-stack detection method for the tray that is a discharge target of sheets S is the method using the number-of-fully-stacked-sheets counter, the sorting apparatus control unit 303 checks whether the number of sheets S discharged to the target tray has reached a threshold number of sheets (S551). If the full-stack detection method for the tray that is a discharge target of sheets S is not the method using the number-of-fully-stacked-sheets counter, the sorting apparatus control unit 303 checks whether the employed full stack detecting sensor has an ON state (S552).

If the discharged number of sheets S reaches the threshold number of sheets or if the full stack detecting sensor has an ON state, the sorting apparatus control unit 303 sets the target tray to a full stack (S553). This prohibits discharging of sheets S to the target tray. The sorting apparatus control unit 303 checks again the full-stack detection method after a full stack is detected (S554). If the full-stack detection method is the method using the number-of-fully-stacked-sheets counter, the sorting apparatus control unit 303 waits for a press of the CANCEL FULL STACK button 80*b* presented on the operation panel 240 (S555). If the full-stack detection method is not the method using the number-of-fully-stacked-sheets counter, the sorting apparatus control unit 303 waits for a change to an OFF state of the signal from the full stack detecting sensor (S556). After determining that the CANCEL FULL STACK button 80*b* has been pressed or the signal from the full stack detecting sensor is changed to OFF, the sorting apparatus control unit 303 cancels the full stack (S557). Thus, discharging sheets S to the target tray is permitted. The controls in this flowchart end here.

According to this embodiment, when a discharge tray is detached so that more sheets S can be stacked, the number of discharged sheets S is counted for detection of a full stack. Thus, before the stackability decreases, a full stack can be detected, and the printing operation can be stopped. The method using the number-of-fully-stacked-sheets counter or the full stack detecting sensor may be selected so that a proper full-stack detection method can be selected in accordance with the configuration and size of the sheet sorting apparatus 200. A fully stacked condition can be cancelled easily so that printing can be restarted by cancelling the fully stacked condition.

Variation Example 1

According to Embodiment 1, the CANCEL FULL STACK button 80*b* displayed on the operation panel 240 may be pressed by a user to cancel the fully stacked condition. However, embodiments of the present disclosure are not limited thereto.

FIG. 11 illustrates schematic structure of an image forming apparatus according to Variation Example 1. Variation Example 1 is different from Embodiment 1 in that sheet detecting sensors 430, 431, and 432 are provided. The sheet detecting sensors 430, 431, and 432 are sensors configured to detect the presence or absence of a sheet S stacked in the discharge trays 210, 211, and 212, respectively. The sheet detecting sensors 430, 431, and 432 may be photo-interrupters, for example, and are configured to output an OFF signal in a through-beam mode in which no sheet S is stacked in the respective discharge tray 210, 211, and 212 and the light beams from the photo-interrupters are not shielded. The sheet detecting sensors 430, 431, and 432 output an ON signal in a beam shielded mode in which a sheet S is stacked in the respective discharge trays 210, 211, and 212 and light beams from the photo-interrupters are shielded by flags, not illustrated.

Figure 12:
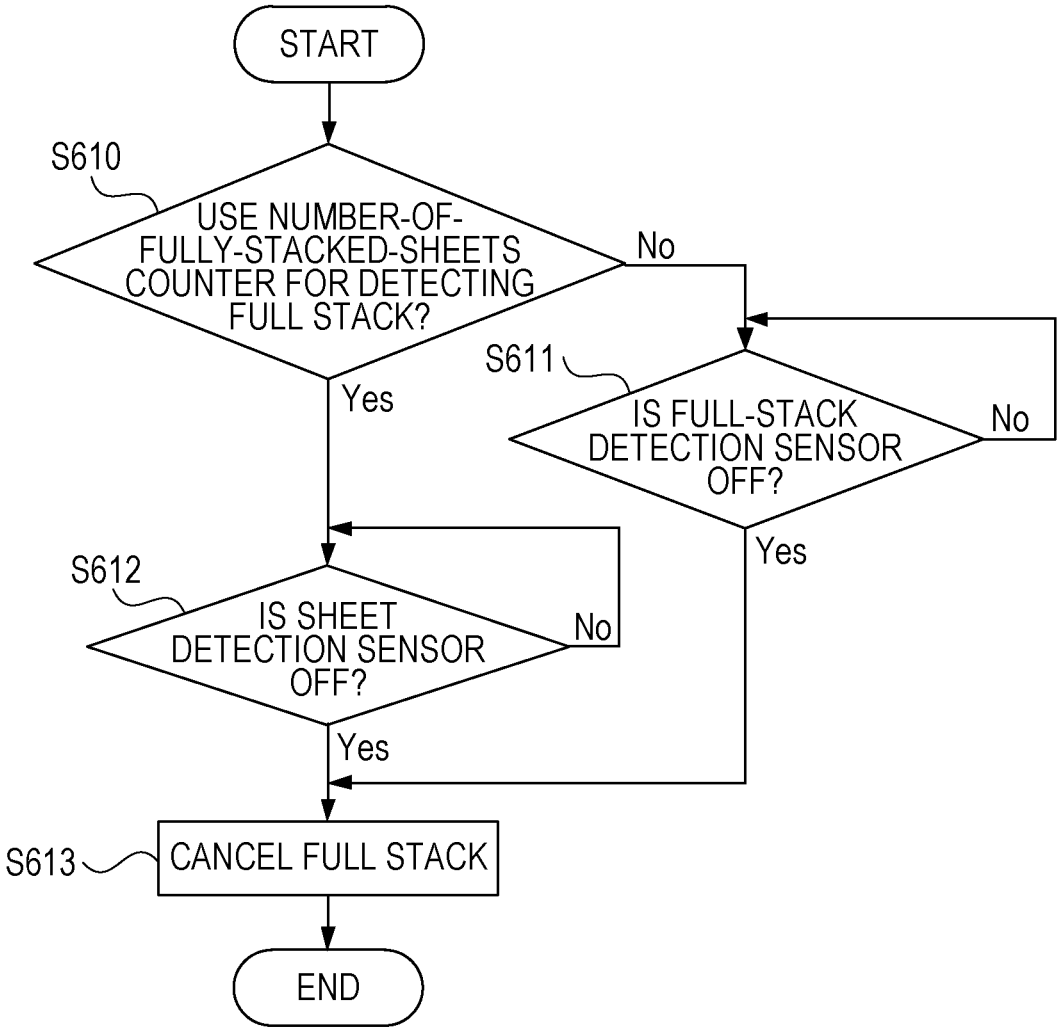
FIG. 12 is a flowchart for releasing a full stack according to Variation Example 1.

FIG. 12 is a flowchart for cancelling a fully stacked condition according to Variation Example 1. The controls based on the flowchart in FIG. 12 are executed based on a program stored in a ROM, not illustrated, in the sorting apparatus control unit 303 illustrated in FIG. 2.

After a full stack of a target tray is detected, the sorting apparatus control unit 303 checks whether the full-stack detection method for the target tray is the method using the number-of-fully-stacked-sheets counter (S610). If the full-stack detection method is a method using the full stack detection counter, the sorting apparatus control unit 303 waists for turning off of the signal from the sheet detecting sensor corresponding to the target tray (S612). If the full-stack detection method is not the method using the number-of-fully-stacked-sheets counter (S610: No), the sorting apparatus control unit 303 waists for a change to an OFF state of the signal from the full stack detecting sensor (S611). If it is determined that the sheet detecting sensor has an OFF state or the signal from the full stack detecting sensor is changed to an OFF state, the sorting apparatus control unit 303 cancels the full stack (S613) and notifies the full stack cancellation to the controller 301. Thus, the discharge of sheets S to the target tray is permitted.

According to Variation Example 1, as described above, a full stack can be cancelled to restart printing without an instruction from a user in accordance with the sheet presence or absence state of a discharge tray, refining usability.

Variation Example 2

According to Embodiment 1, a reflection type optical sensor is used as each of the full stack detecting sensor 404, 405, and 406. However, embodiments of the present disclosure are not limited thereto.

Figure 13:
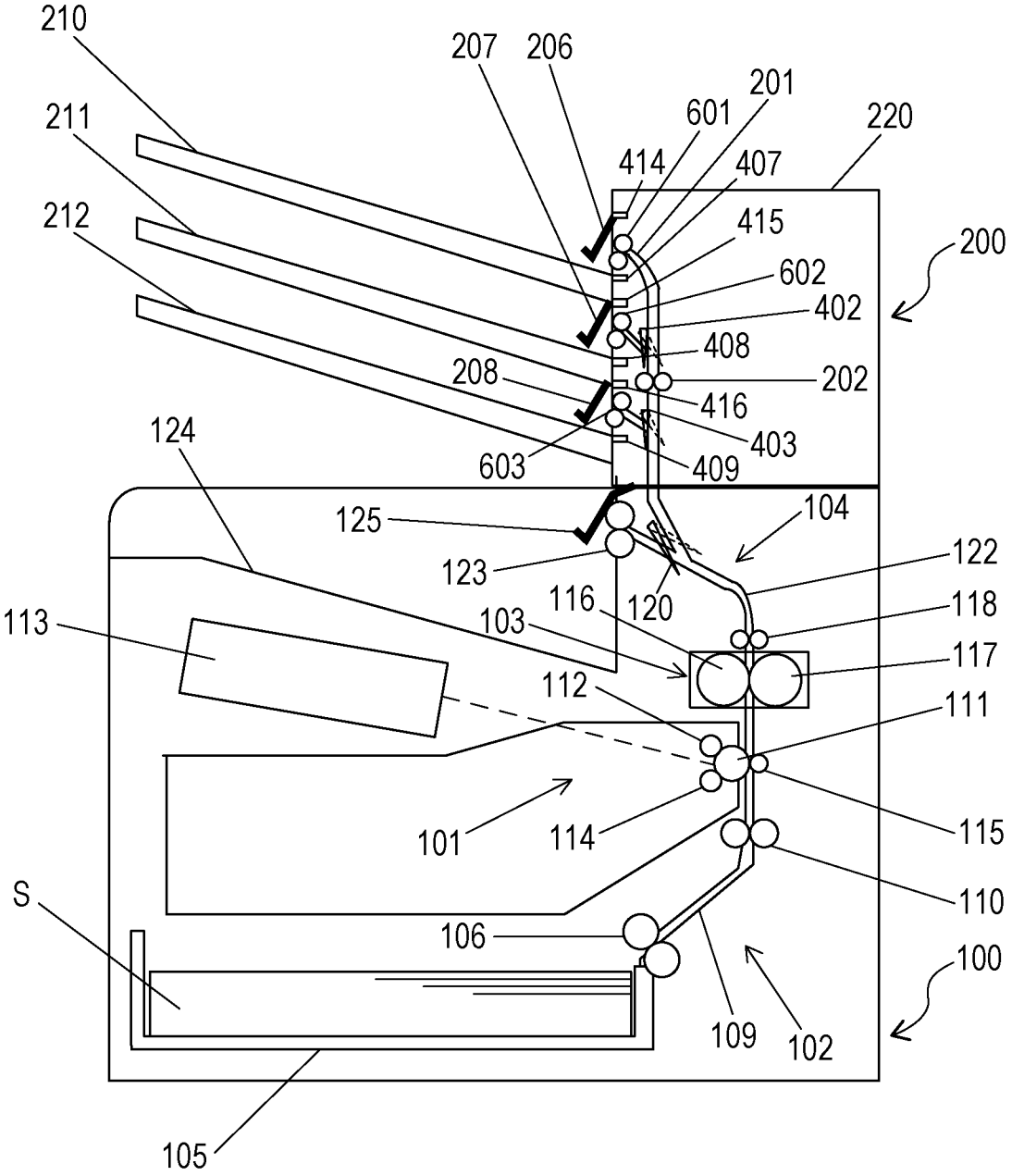
FIG. 13 illustrates configurations of an image forming apparatus and a sheet sorting apparatus according to Variation Example 2.

FIG. 13 illustrates a schematic structure of an image forming apparatus according to Variation Example 2. Variation Example 2 is different from Embodiment 1 in that full stack detection flags 206, 207, and 208 instead of the full stack detecting sensor 404, 405, 406, which are reflection type optical sensors, and full stack detecting sensors 414, 415, and 416 are provided.

The full stack detection flags 206, 207, and 208 are flags which move in contact with the surface of sheets S discharged to the discharge trays 210, 211, and 212, respectively. The full stack detecting sensors 414, 415, 416 are sensors (signal output units) configured to detect a full stack of the discharge trays 210, 211, and 212. The full stack detecting sensor 414, 415, 416 may be photo-interrupters, for example, and are configured to output an OFF signal in a through-beam mode in which light beams from them are not shielded by the full stack detection flags 206, 207, and 208. When a sheet S is discharged to one of the discharge trays 210, 211, and 212, the corresponding one of the full stack detection flags 206, 207, and 208 moves so that the corresponding one of the full stack detecting sensor 414, 415, and 416 outputs an ON signal in a beam shielded mode in which the light beam is shielded by the corresponding one of the full stack detection flags 206, 207, and 208.

According to Variation Example 2, the full stack detection flag 207 integrated with the discharge tray 210 and the full stack detection flag 208 integrated with the discharge tray 211 are detachable from the apparatus main body 220. In other words, the full stack detection flag 207 is attached to the discharge tray 210, and the full stack detection flag 208 is attached to the discharge tray 211.

In this configuration, detection by the full stack detecting sensors 414 and 415 of the stacked amount of sheets S discharged to the discharge tray 212 is difficult when the discharge trays 210 and 211 are detached from the apparatus main body 220, for example. Against the issue, a control is performed to count the number of discharged sheets S and to change the discharging port to discharge the sheets S based on the counted number of sheets S or to discharge the sheets S from an uppermost discharging port in the perpendicular direction.

According to Variation Example 2, the full stack detection flag 207 and the discharge tray 210 are integrated. However, they may be detachable separately, or only the discharge tray 210 may be detachable. When the full stack detection flag 207 is not detachable from the apparatus main body 220, the full stack detection flag 207 can be retracted to an internal part of the apparatus main body 220 not to disturb discharging of a sheet S from the discharging port 203 to the discharge tray 211.

Others Variation Examples

According to Embodiment 1, all of the trays 210, 211, 212 are detachable from the apparatus main body 220. However, embodiments of the present disclosure are not limited thereto. Only the discharge tray 210 may be detachable, and the discharge trays 211 and 212 may not be detachable. In other words, at least one discharge tray may be detachable from the apparatus main body 220 excluding the lowest discharge tray in the perpendicular direction.

The present disclosure is applicable to a case where the discharge trays 210, 211, and 212 are detached from the apparatus main body 220 to increase the sheet stacking space of the discharge tray 124. In this case, the full stack detection flag 125 may be detached integrally with the discharge tray 212.

Having described that, according to Embodiment 1, the CANCEL FULL STACK button 80*b* is displayed on the operation panel 240, a special button switch may be provided on the apparatus main body 220 instead.

According to Embodiment 1, the printer control unit 302 and the sorting apparatus control unit 303 are separately provided. However, only the printer control unit 302 may be provided. In this case, the printer control unit 302 may control the sheet sorting apparatus 200.

According to Embodiment 1, the sheet sorting apparatus 200 may be detachable from the printer 100 or may be fixed integrally to the printer 100.

Having described that, according to Embodiment 1, three discharge trays 210, 211, and 212 are provided, the number of discharge trays is not limited to three. The number of discharge trays may be set in accordance with the environment in which the sheet sorting apparatus 200 is to be used, the number of users sharing the sheet sorting apparatus 200 or specifications of the sheet sorting apparatus 200.

According to Embodiment 1, the image forming apparatus is a laser beam printer, for example. However, the image forming apparatus to which the present disclosure is applied is not limited thereto but may be a printer or a copier based on other printing methods such as an ink-jet printer.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-008790, filed Jan. 23, 2018, which is hereby incorporated by reference herein in its entirety.

What is claimed is:

1. A sheet sorting apparatus comprising:

a first tray detachable from an apparatus main body;

a second tray arranged below the first tray in a vertical direction;

a conveyance unit configured to convey a sheet to the first tray or the second tray;

a tray detection unit configured to detect that the first tray is detached from the apparatus main body;

a sheet detection unit configured to detect that an amount of the sheet stacked on the first tray reaches a predetermined amount, wherein the sheet detection unit is capable of detecting the sheet stacked on the second tray in a case where the first tray is detached from the apparatus main body; and a control unit configured to control the conveyance unit, wherein, in a case where the sheet detection unit detects that the amount of the sheet reaches the predetermined amount, the control unit is configured to control the conveyance unit not to convey the sheet to the first tray, and wherein, in a case where the tray detection unit detects that the first tray is detached from the apparatus main body, the control unit is configured to control the conveyance unit to convey a first sheet to the second tray, and then, the control unit is configured to control the conveyance unit not to convey a second sheet, which is different from the first sheet, to the second tray before the sheet detection unit detects the sheet stacked on the second tray.

2. The sheet sorting apparatus according to claim 1, wherein, in the case where the tray detection unit detects that the first tray is detached from the apparatus main body, the control unit is configured to control the conveyance unit not to convey the second sheet to the second tray when a number of sheets stacked on the second tray reaches a threshold number of sheets.

3. The sheet sorting apparatus according to claim 1, wherein the predetermined amount is a first predetermined amount, the sheet sorting apparatus further comprising a second sheet detection unit configured to detect that an amount of the sheet stacked on the second tray reaches a second predetermined amount, wherein, in a case where the tray detection unit detects that the first tray is not detached from the apparatus main body, the control unit is configured to control the conveyance unit not to convey the sheet to the second tray when the second sheet detection unit detects that the amount of the sheet reaches the second predetermined amount.

4. The sheet sorting apparatus according to claim 3, wherein, in a case where the first tray is attached to the apparatus main body and when there is a state transition from a state where the second sheet detection unit detects the sheet stacked on the second tray to a state where the second sheet detection unit does not detect the sheet stacked on the second tray, the control unit is configured to permit the conveyance unit to convey the sheet to the second tray.

5. The sheet sorting apparatus according to claim 1, further comprising an operational display unit, wherein, in a case where (i) the first tray is detached from the apparatus main body and when a number of sheets conveyed to the second tray reaches a threshold number of sheets, (ii) information indicating that the second tray is in a fully stacked condition is displayed on the operational display unit, and (iii) when a full stack cancel instruction is given externally through the operational display unit, the control unit is configured to permit the conveyance unit to convey the sheet to the second tray.

6. The sheet sorting apparatus according to claim 1, wherein the sheet detection unit includes an optical sensor configured to apply light to the sheet stacked on the first tray and receive light reflected by a surface of the sheet.

7. The sheet sorting apparatus according to claim 1, wherein the sheet detection unit includes a flag to be moved in contact with a surface of the sheet stacked on the first tray and a signal output unit configured to output a signal based on a position of the flag.

8. The sheet sorting apparatus according to claim 3, wherein the second sheet detection unit includes a flag to be moved in contact with a surface of the sheet stacked on the second tray and a signal output unit configured to output a signal based on a position of the flag, and wherein the flag is detachable from the apparatus main body along with the first tray.

9. A sheet sorting apparatus comprising:

a first tray detachable from an apparatus main body;

a second tray detachable from the apparatus main body and arranged below the first tray in a vertical direction;

a third tray arranged below the second tray in the vertical direction;

a conveyance unit configured to convey a sheet to the first tray, the second tray, or the third tray;

a tray detection unit configured to detect that the first tray is detached from the apparatus main body and the second tray is detached from the apparatus main body;

a first sheet detection unit configured to detect that an amount of the sheet stacked on the first tray reaches a first predetermined amount;

a second sheet detection unit configured to detect an amount of the sheet stacked on the second tray reaches a second predetermined amount in a first state where the second tray is attached to the apparatus main body, and configured to detect that an amount of the sheet stacked on the third tray reaches a third predetermined amount in a second state where the second tray is detached from the apparatus main body; and a control unit configured to control the conveyance unit, wherein, in a case where the first sheet detection unit detects the sheet on the first tray, the control unit is configured to control the conveyance unit not to convey the sheet to the first tray, wherein, in a case where the second sheet detection unit detects the sheet on the second tray, the control unit is configured to control the conveyance unit not to convey the sheet to the second tray, wherein, in a case where the tray detection unit detects that the first tray is not detached from the apparatus main body and the second tray is detached from the apparatus main body, the control unit is configured to control the conveyance unit to convey a first sheet to the third tray, and then, the control unit controls the conveyance unit not to convey a second sheet, which is different from the first sheet, to the third tray when the second sheet detection unit detects that the amount of the sheet reaches the third predetermined amount, and wherein, in a case where the tray detection unit detects that the first tray and the second tray are detached from the apparatus main body, the control unit is configured to control the conveyance unit to convey a third sheet, which is different from the second sheet, to the third tray, and then, the control unit is configured to control the conveyance unit not to convey a fourth sheet, which is different from the third sheet, to the third tray before the first sheet detection unit detects the sheet stacked on the third tray.

10. The sheet sorting apparatus according to claim 9, wherein, in the case where the tray detection unit detects that the first tray and the second tray are detached from the apparatus main body, the control unit is configured to control the conveyance unit not to convey the fourth sheet to the third tray when a number of sheets stacked on the third tray reaches a threshold number of sheets.

11. An image forming apparatus comprising:

an image forming unit configured to form an image on a sheet;

a first tray detachable from an apparatus main body;

a second tray arranged below the first tray in a vertical direction;

a conveyance unit configured to convey a sheet on which the image has been formed by the image forming unit to the first tray or the second tray;

a tray detection unit configured to detect that the first tray is detached from the apparatus main body;

a sheet detection unit configured to detect that an amount of the sheet stacked on the first tray reaches a predetermined amount; and a control unit configured to control the conveyance unit, wherein, in a case where the sheet detection unit detects that the amount of the sheet reaches the predetermined amount, the control unit is configured to control the conveyance unit not to convey the sheet to the first tray, and wherein, in a case where the tray detection unit detects that the first tray is detached from the apparatus main body, the control unit is configured to control the conveyance unit to convey a first sheet to the second tray, and then, the control unit is configured to control the conveyance unit not to convey a second sheet, which is different from the first sheet, to the second tray before the sheet detection unit detects the sheet stacked on the second tray.

* * * * *